US008066453B2

(12) United States Patent
Heindl

(10) Patent No.: US 8,066,453 B2
(45) **Date of Patent: *Nov. 29, 2011**

(54) CONNECTION ELEMENT AND A SHEET PILE WALL WITH CONNECTION ELEMENT THEREFOR

(75) Inventor: Richard Heindl, Munich (DE)

(73) Assignee: Pilepro, LLC, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/087,414

(22) Filed: Apr. 15, 2011

(65) Prior Publication Data

US 2011/0194903 A1 Aug. 11, 2011

Related U.S. Application Data

(63) Continuation of application No. 12/157,499, filed on Jun. 11, 2008, now Pat. No. 7,955,029.

(30) Foreign Application Priority Data

Jun. 18, 2007 (DE) ..... 10 2007 027 940

(51) Int. Cl.
*E02D 5/02* (2006.01)

(52) U.S. Cl. ..... 405/274; 405/277; 405/278; 405/279

(58) Field of Classification Search ..... 405/274, 405/277, 278, 279; 403/363
See application file for complete search history.

(56) References Cited

U.S. PATENT DOCUMENTS 7,955,029 B2 * 6/2011 Heindl ..... 405/274

* cited by examiner

*Primary Examiner* — David Bagnell
*Assistant Examiner* — Benjamin Fiorello
(74) *Attorney, Agent, or Firm* — Karl F. Milde, Jr.; Eckert Seamans Cherin & Mellott, LLC

(57) ABSTRACT

A connection element (10), having a constant cross-section for sheet pile wall components such as sheet piles, features a claw profile (12) for engaging a head strip (44) of a sheet pile wall component (42). The claw profile (12) exhibits a claw-shaped lock (22) formed by two hook strips (18, 20) as well as an attachment profile (14) for engaging in a claw-shaped lock (46) of a sheet pile wall component (42). The attachment profile (14) exhibits a straight neck strip (32) and a head strip (34) of a greater cross-section at its free end. An additional head strip (38) for securing a claw-shaped lock (46) of a sheet pile wall component (42) is formed at the free end section (28) of at least one of the hook strips (20) of the claw profile (12).

17 Claims, 8 Drawing Sheets

CONNECTION ELEMENT AND A SHEET PILE WALL WITH CONNECTION ELEMENT THEREFOR

CROSS-REFERENCE TO RELATED APPLICATION

This application is a continuation application of U.S. patent application Ser. No. 12/157,499, filed Jun. 11, 2008, now pending.

BACKGROUND OF THE INVENTION

The invention relates to a connection element with a constant cross-section for sheet pile wall components, such as sheet piles with a claw profile for engaging a head strip of a sheet pile wall component, whereby the claw profile exhibits a claw-shaped lock chamber formed by two hook strips, as well as an attachment profile for engaging in a claw-shaped lock of a sheet pile wall component, whereby the attachment profile exhibits a straight neck strip and a head strip of a greater cross-section provided at its free end. In addition, the invention relates to a sheet pile wall comprised of several sheet piles, where at least two of the sheet piles are connected to each other through a connection element of the type mentioned above.

A connection element of the type mentioned above is known from DE 203 19 175 U1 and from DE 20 2004 018 659 U1. This known connection element is used for connecting sheet pile wall components to each other, which are equipped with so-called ball-and-socket locks. This includes conventional Z- or U-sheet piles with ball-and-socket locks as well as T-beams and I-beams as described in DE 103 07 414 A1 that are provided with ball locks and/or socket locks at the free ends of their flanges. In this context, a ball lock refers to a lock that is formed in the shape of a head strip that stretches along the entire longitudinal edge of the sheet pile and has an oval cross-section. A socket lock refers to a lock with a claw-shaped cross-section in which the ball lock of a sheet pile wall component can engage.

Using the known connection elements, it is possible to couple sheet pile wall components to each other that run at different angles to each other. To this end, the connection element that exhibits a constant cross-section is provided with an attachment profile and a claw profile and in its length is adapted to the lengths of the respective sheet pile wall components that are to be connected.

SUMMARY OF THE INVENTION

Based on this state of the art, it is the principle objective of the present invention to develop the connection element mentioned above such that it can be employed even more flexibly.

Based on the invention, the objective is achieved by forming at least one of the hook strips of the claw profile at the free end section as an additional head strip for engaging a claw-shaped lock of a sheet pile wall component.

The connection element based on the invention, which is particularly suitable for connecting sheet pile wall components with ball-and-socket locks distinguishes itself from the known connection elements as described above through greater flexibility in its application. For example, the claw profile of the connection element based on the invention fulfills a double function by providing the additional head strip at one of its hook strips. It can be used not only to engage the head strip of a sheet pile wall component but at the same time is suited for engaging in a claw-shaped lock of a sheet pile wall component. To this end, the additional head strip provided at the claw profile is preferably formed directly at the hook strip. If useful, the head strip can also be attached to the claw profile via a short neck strip with the contour and length of the neck strip being designed such that engaging a lock in the claw-shaped lock chamber of the claw profile is not impaired. When using a connection element based on the invention, great flexibility is achieved with regard to the arrangement and number of sheet pile wall components when erecting sheet pile walls. For example, it is immaterial when attaching the connection element, whether the lock at the sheet pile wall component that is to be coupled with the claw profile of the connection element is a head strip or a claw-shaped lock. The connection element based on the invention is formed of one piece and is preferably manufactured by extrusion molding.

In addition, it shall be noted that all progressions of contours, axes, etc. as referenced and defined in the description and the claims shall always be viewed at a cross-sectional plane that is at a right angle to the longitudinal axis of the connection element.

For example, the head strip is preferably integrated directly in the hook strip of the claw profile. To this end, in a particular advantageous development of the connection element based on the invention, the hook strip that is provided with the additional head strip has a curved contour, while the free end section of the curved hook strip transitions into the additional head strip such that the free end section of the curved hook strip forms a portion of the outer contour of the additional head strip and at the same time a portion of the inner contour of the lock chamber. The transition of the end section of the hook strip into the head strip is seamless. This is achieved in particular through the inner contour of the hook strip and the transition into the head strip being realized through a succession of appropriately dimensioned radii.

Preferably, the claw-shaped lock chamber of the claw profile exhibits an oval cross-section in order for the head strip of the sheet pile wall that is engaged in the claw profile of the connection element based on the invention to be held securely in the claw profile and for said head strip to be pivotable in the claw profile to compensate for deviations in the progression of the sheet pile wall. In this case, the inner contours of the curved hook strips of the claw profile that border the lock chambers run mirror-symmetrical to each other, while the ends of the hook strips define the open jaw of the claw-shaped lock chamber. Preferably, the shape of the oval cross-section is designed such that the main axis of the oval, i.e., the axis along which the oval cross-section of the lock chamber has the greatest inside dimension, extends perpendicular to the main direction of attachment of the claw profile along which the sheet pile wall component in its neutral position shall engage in the claw profile.

In this context, main direction of attachment refers to the direction of attachment along which the sheet pile wall component with its lock in a neutral position engages in the head strip of the attachment profile, in the claw-shaped lock chamber of the claw profile or in the head strip of the claw profile of the connection element based on the invention, and from which the sheet pile wall component can pivot clockwise or counterclockwise at least by approximately the same angular degree.

To establish a defined pattern of the sheet pile wall components that are to engage in the claw profile, the main direction of attachment of the claw profile, along which the sheet pile wall component in its neutral position shall engage in the claw profile, and the main direction of attachment of the additional head strip provided at the claw profile preferably run parallel to each other.

The head strip of the attachment profile and the additional head strip of the claw profile exhibit preferably at least almost identical, oval cross-sectional shapes, whereby the main axes of the head strips with the oval cross-section run perpendicular to their respective main direction of attachment, along which the sheet pile wall components shall engage in their respective neutral position. This ensures that the connection elements based on the invention can be used in the same manner without difficulties for all sheet pile wall components using ball-and-socket locks.

To enable a very flexible use of the connection element based on the invention, connection elements are recommended that connect the sheet pile wall components to each other at different angles. For example, it is recommended to arrange the attachment profile and the claw profile in relation to each other such that the main direction of attachment of the attachment profile extends at a pre-specified angle, preferable an angle of 45°, 90°, 135° or 180° relative to the main direction of attachment of the claw profile. When providing these connection elements with various connection angles and when taking into account the pivotability of the locks of the sheet pile wall components, which can pivot by up to 20° from the main direction of attachment both clockwise and counterclockwise, a particularly great flexibility is achieved with regard to the use of the connection elements based on the invention.

Should three or even four sheet pile wall components be coupled by the connection element based on the invention, it is recommended to provide the connection element with at least one additional attachment profile or an additional claw profile.

For example, in a particularly advantageous development of the connection element based on the invention, it is recommended to provide the connection element with a claw profile and two attachment profiles, whereby the main direction of attachment of the one attachment profile extends at an angle of 90° relative to the main direction of attachment of the claw profile, while the second identically designed attachment profile extends with its main direction of attachment at an angle of 180° relative to the main direction of attachment of the claw profile.

In an alternative development of this connection element with a claw profile and two attachment profiles, it is recommended to design the connection element such that the main direction of attachment of the one attachment profile extends at an angle of 45° relative to the main direction of attachment of the claw profile, while the second identically designed attachment profile extends with its main direction of attachment at an angle of 135° relative to the main direction of attachment of the claw profile.

In a second alternative development of the connection element with a claw profile and two attachment profiles, the one attachment profile extends with its main direction of attachment at an angle of 90° relative to the main direction of attachment of the claw profile, while the second identically designed attachment profile extends with its main direction of attachment at an angle of 270° relative to the main direction of attachment of the claw profile. In order to increase the flexibility of the connection element further, it is additionally recommended to provide each of the two hook strips of the claw profile with a head strip.

In an alternative development of the connection element based on the invention, it is recommended to provide the connection element with an additional claw profile that exhibits a claw-shaped lock chamber formed by two identically designed hook strips and where the inner contour of said lock chamber corresponds to the inner contour of the lock chamber of the first claw profile.

At this further development, the main direction of attachment of this second claw profile extends preferably at an angle of 90° relative to the main direction of attachment of the first claw profile, while the main direction of the attachment profile extends at an angle of 180° relative to the main direction of attachment of the first claw profile. This provides the opportunity to couple the sheet piles to each other in an angular range of in total 270°. In this case, the second claw profile is preferably designed such that its two hook strips protrude outward from the hook strip of the first claw profile that is not provided with the head strip.

To further increase the flexibility of the connection element based on the invention, the additional claw profile exhibits preferably a head strip at the end section of at least one of its hook strips as well, with said head strip being designed identical to the head strip of the first claw profile, whereby the head strip of the additional claw profile is preferably formed at the end of the hook strip that is at a greater distance to the attachment profile in order to prevent a potential collision between the engaged sheet pile wall components.

Additionally, in a further development of the connection element with two claw profiles, it is recommended to design the two claw profiles mirror symmetrical to each other, whereby the main direction of attachment of the attachment profile extends at a respective angle of 90° relative to the main direction of attachment of the two claw profiles. Furthermore, each claw profile exhibits a head strip at least at its hook strip that is at a distance from the attachment profile. Potentially, both hook strips of each claw profile can be provided with a head strip.

It is furthermore conceivable to provide the connection element that exhibits the two claw profiles, which are mirror-symmetrical to each other, with an additional attachment profile that is designed mirror-symmetrical to the first attachment profile.

According to an additional aspect, the invention relates to a sheet pile wall comprised of several sheet piles, where at least two sheet piles are connected to each other through a connection element based on the invention.

For a full understanding of the present invention, reference should now be made to the following detailed description of eight preferred embodiments of the invention as illustrated in the accompanying drawings.

DESCRIPTION OF THE PREFERRED EMBODIMENTS

Figure 1:
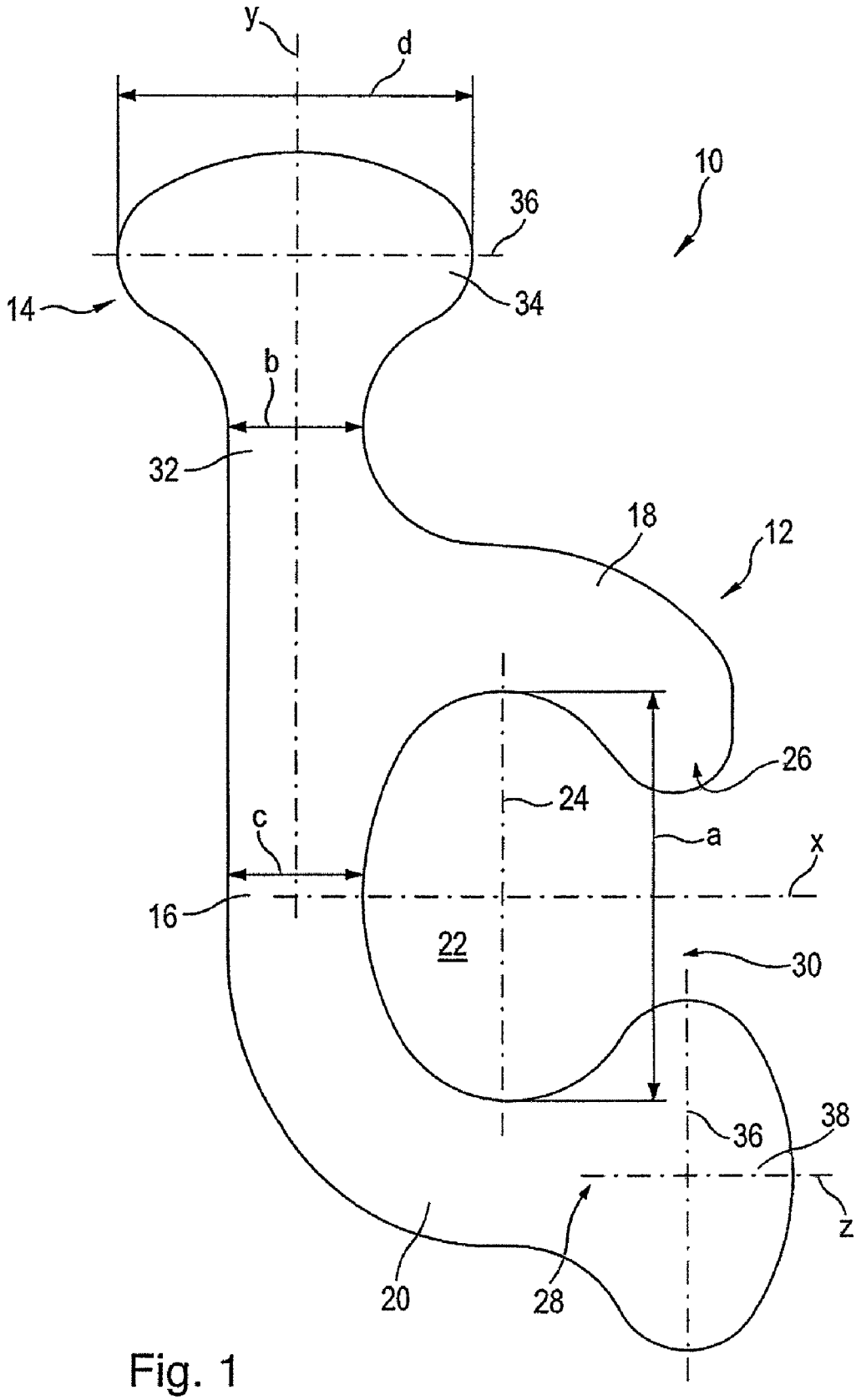
FIG. 1 is a top view of the front face of a first embodiment of a connection element based on the invention with a claw profile and an attachment profile that extends with its main direction of attachment at an angle of 90° to the main direction of attachment of the claw profile.

The preferred embodiments of the present invention will now be described with reference to FIGS. 1-13 of the drawings. Identical elements in the various figures are designated with the same reference numerals.

FIG. 1 shows a top view of the front face of a first embodiment of the connection element 10 based on the invention. The connection element 10 has a uniform cross-sectional shape and with its length is adapted to the length of the sheet pile wall components that shall be connected to each other. With the assistance of the connection element 10, it is possible to connect sheet pile wall components at an angle of 90° to each other. To this end, the connection element 10 features a claw profile 12 and an attachment profile 14.

The claw profile 12 is formed of a center strip 16 as well as two hook strips 18 and 20 protruding in the same direction from said center strip. The hook strips 18 and 20 arise smoothly from the center strip 16 building a curve, and run towards each other in a mirror-symmetrical, curve-like manner. The two hook strips 18 and 20 are designed and dimensioned such that the claw-shaped lock chamber 22 that is partially enclosed by the two hook strips 18 and 20 exhibits an at least approximate oval cross-sectional shape.

The shape of the oval cross-section is designed such that the main axis 24 of the oval, i.e., the axis along which the oval cross-section of the lock chamber 22 has the greatest inside dimension a, extends perpendicular to the main direction of attachment X of the claw profile 12. The main direction of attachment X shown in FIG. 1 as a dot and dash line corresponds to the symmetry axis of the lock chamber 22. The free end sections 26 and 28 of the two hook strips 18 and 20 are at a distance from each other and form a jaw 30 located at the center into which later the lock of the engaging sheet pile wall component will protrude.

Adjacent to the hook strip 18 shown in FIG. 1 above, the center strip 16 transitions into the attachment profile 14 whose main direction of attachment Y in FIG. 1 extends counterclockwise offset by 90° to the main direction of attachment X of the claw profile 12. The attachment profile 14 is formed of a straight running neck strip 32 that has a head strip 34 formed at its free end. The main direction of attachment Y of the attachment profile 14 shown in FIG. 1 as a dot and dash line as well coincides with the longitudinal axis of the neck strip 32.

The neck strip 32 has a thickness b, which corresponds to approximately 0.8 to 1 times the thickness c of the center strip 16, while the length of the neck strip 32 viewed in the longitudinal direction of the center strip 16 corresponds to approximately 1 to 2 times the thickness c of the center strip 16. In the shown embodiment, both the thickness b and the length of the neck strip 32 correspond to the thickness c of the center strip 16.

The head strip 34 has an oval cross-section, with the main axis 36 of the head strip 34 running at a right angle to the longitudinal direction of the neck strip 32. The greatest width d of the oval of the head strip 34 viewed in the direction of the main axis 36 corresponds to approximately 2 to 3 times the thickness b of the neck strip 32 and extends perpendicular to the main direction of attachment Y. In the shown embodiment, the greatest width d of the oval of the head strip 34 is at approximately 2.5 times the thickness b of the neck strip 32.

Based on the invention, the greatest inside dimension a of the inner contour of the lock chamber 22 of the claw profile 12 corresponds to 2.5 to 4 times the thickness b of the neck strip 32. In the shown embodiment, the greatest inside dimension a of the inner contour corresponds to approximately 2.8 times the thickness b of the neck strip 32. The width of the jaw 30 corresponds to approximately half of the greatest inside dimension a of the inner contour of the lock chamber 22.

Based on the invention, the hook strip 20 of the claw profile 12 shown in FIG. 1 at the bottom is furthermore provided with an additional head strip 38 at its end section 28. The head strip 38 exhibits an oval cross-section as well and corresponds in its outer dimensions at least approximately to the outer dimensions of the head strip 34 of the attachment profile 14. The main axis 40 of the additional head strip 38 extends perpendicular to the symmetry axis of the claw profile 12, and thus also perpendicular to the main direction of attachment X of the claw profile 12. The main direction of attachment Z of the additional head strip 38, therefore, extends parallel to the main direction of attachment X of the claw profile 12.

The oval shape of the cross-section of the claw-shaped lock chamber 22 of the claw profile 12 is designed such that the inner contours of the curved hook strips 18 and 20 of the claw profile 12 that define the lock chamber 22 run at least approximately mirror-symmetrical to each other. The hook strip 20 that is provided with the additional head strip 38 transitions with its free end section 28 into the additional head strip 38 such that the free end section 28 of the curved hook strip 20 forms a portion of the outer contour of the additional head strip 38 and at the same time a portion of the inner contour of the lock chamber 22.

Figure 2:
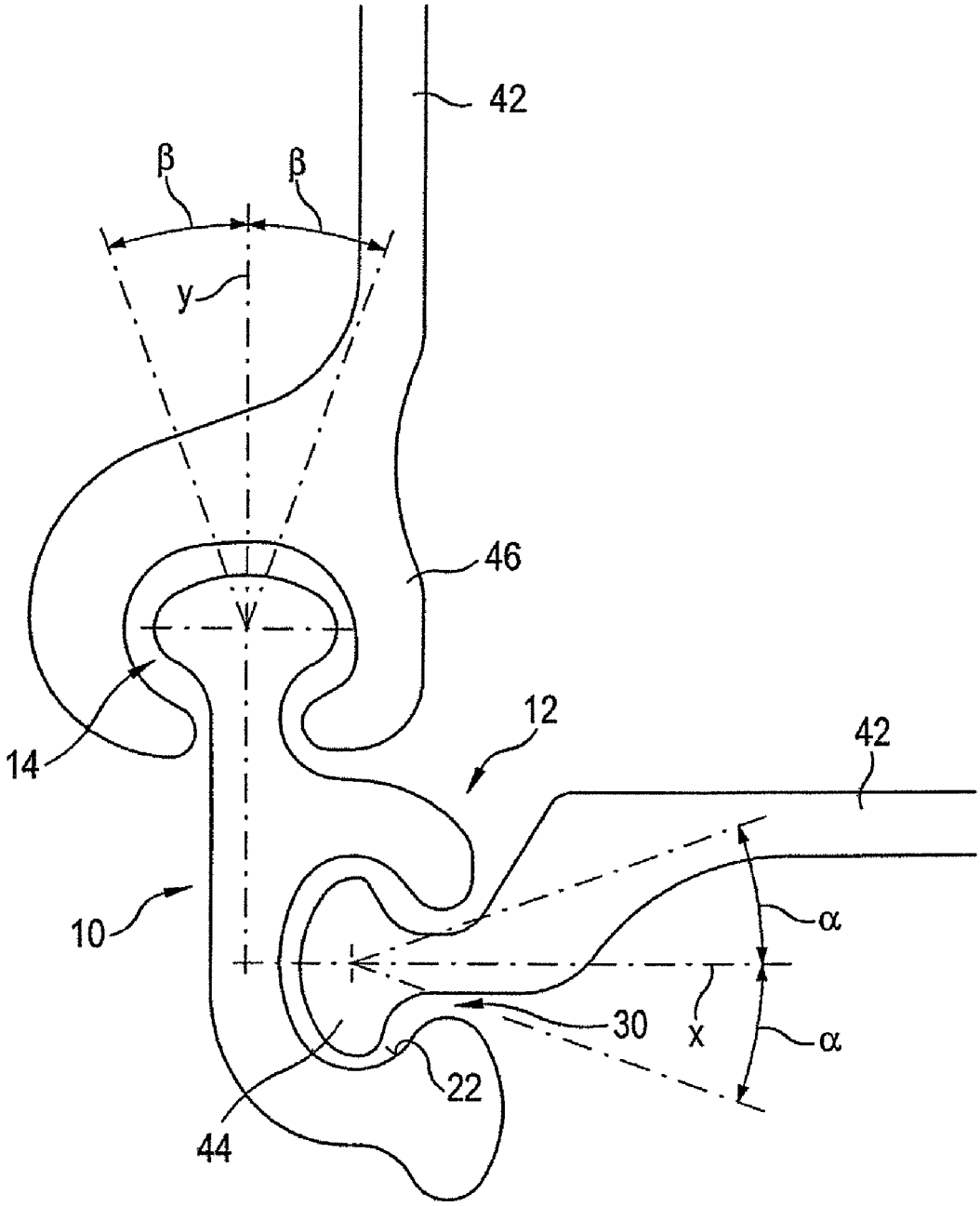
FIG. 2 is a top view of a front face of the connection element shown in FIG. 1 with a head strip of a first sheet pile engaged in its claw profile and with its attachment profile engaged in the claw-shaped lock of the second sheet pile.
Figure 3:
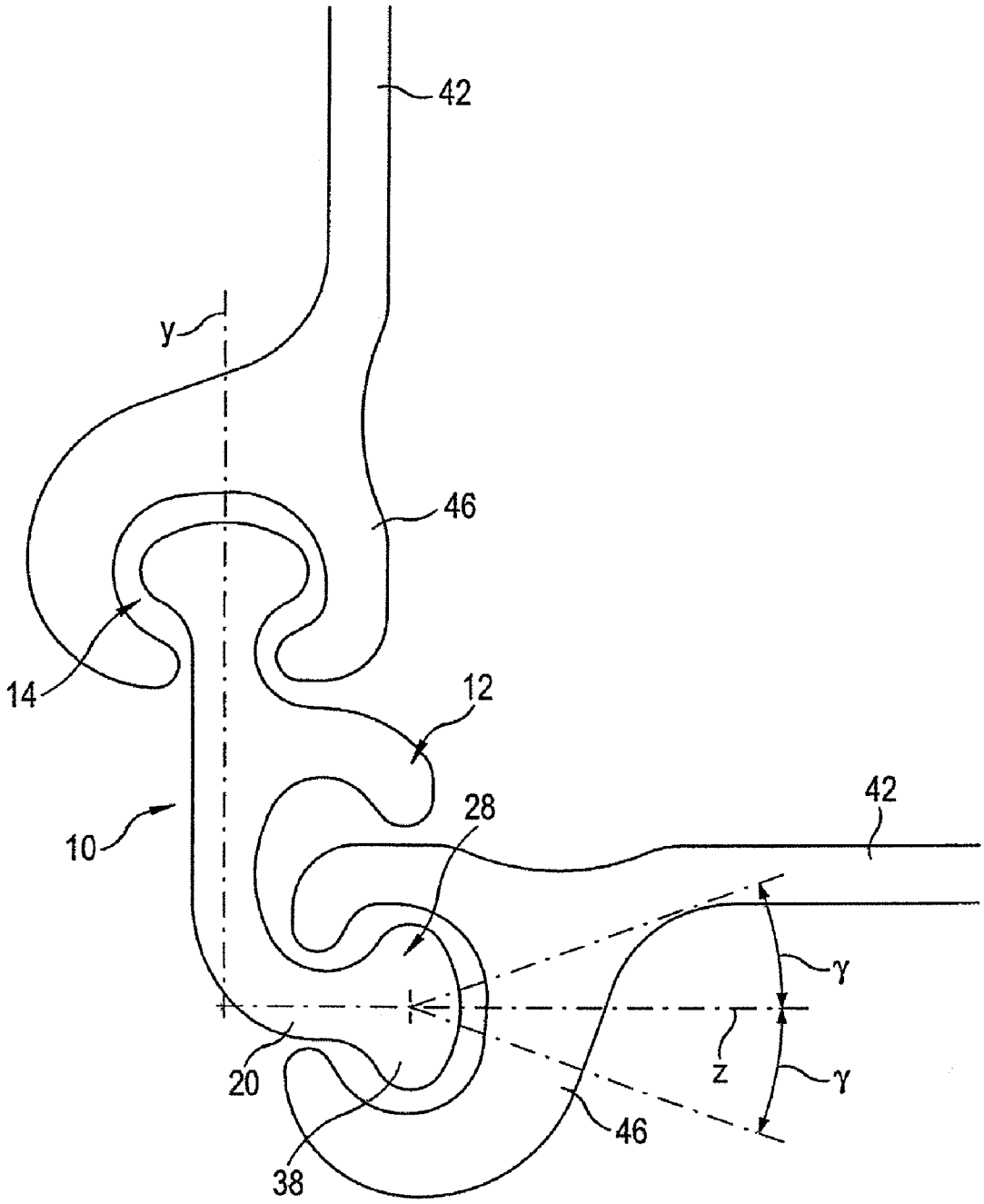
FIG. 3 is a top view of the front face of the connection element shown in FIG. 1 that differs from the top view shown in FIG. 2 in that a claw-shaped lock of a second sheet pile is engaged in the head strip provided at the claw profile.

FIGS. 2 and 3 show applications of the connection element 10.

In the application shown in FIG. 2, a sheet pile 42 with its lock 44 designed as a head strip engages in the claw lock 12 of the connection element 10 and extends with its lock 44 in the direction of the main direction of attachment X. Due to the shape and size of the lock chamber 22 and the jaw 30, the lock 44 of the sheet pile 42 can pivot clockwise and counterclockwise by a respective angle $\alpha$ of approximately 20° from the main direction of attachment X as indicated by the dashed line.

The attachment profile 14 of the connection element 10 engages with a claw-shaped lock 45 of an identical sheet pile 42 and in the shown application extends with its lock 46 along the main direction of attachment Y. Here too it is possible to pivot the sheet pile 42 clockwise and counterclockwise by an angle $\beta$ of approximately 20° versus the main direction of attachment Y as indicated by the dashed line.

With the application shown in FIG. 3, the sheet pile 42 that engages in the attachment profile 14 engages corresponding to the application shown in FIG. 2. The sheet pile 42 that engages with the claw profile 12, on the other hand, engages with its claw-shaped lock 46 in the additional head strip 38 that is provided at the free end section 28 of the hook strip 20 shown at the bottom of FIG. 3. Based on the shape and the pattern of the additional head strip 38, the sheet pile 42 can pivot by an angle $\gamma$ of approximately 20° clockwise and counterclockwise versus the main direction of attachment Z here as well as indicated by the dot and dash line.

The advantage of the connection element 10 based on the invention is obvious. Because of the additional head strip 38, when erecting a sheet pile wall, it is no longer necessary to observe, which type of lock, i.e., head strip or claw-shaped lock, is provided at the sheet pile 42 that is to be coupled with the claw profile 12 of the connection element 10.

The following embodiments are formed from the two basic forms of the claw profile 12 and the attachment profile 14, whereby the ratios of the quantities a, b, c, and d described above are adopted accordingly. Furthermore, for the sake of simplicity, corresponding base forms have been given identical reference characters in the embodiments described below.

Figure 4:
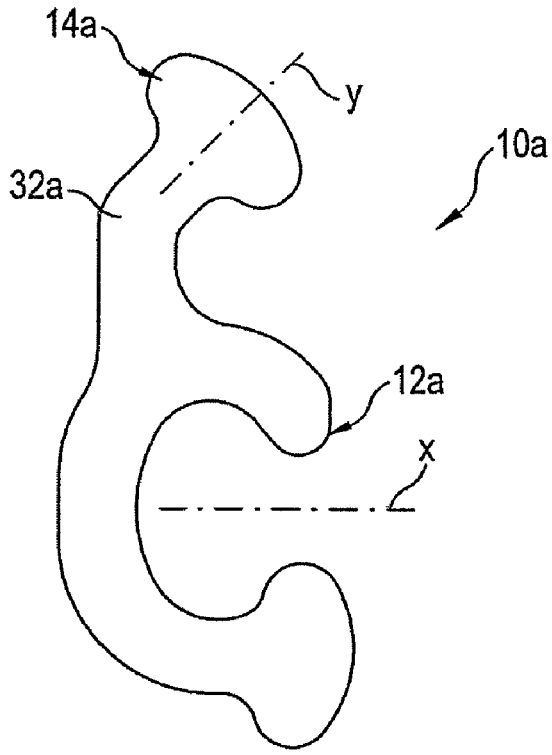
FIG. 4 is a top view of the front face of a second embodiment of a connection element based on the invention, where the attachment profile is molded to the claw profile through a connection strip and extends with its main direction of attachment at an angle of 45° to the main direction of attachment of the claw profile.

FIG. 4 shows a top view of the front face of a second embodiment of a connection element 10*a* based on the invention. All significant design features such as shape and size ratios of the claw profile 12*a* and the attachment profile 14*a* correspond to those of the first connection element 10. The only difference is that the neck strip 32*a* of the attachment profile 14*a* is angled such that the main direction of attachment Y of the attachment profile 14*a* extends at an angle of 45° to the main direction of attachment X of the claw profile 12*a*.

Figure 5:
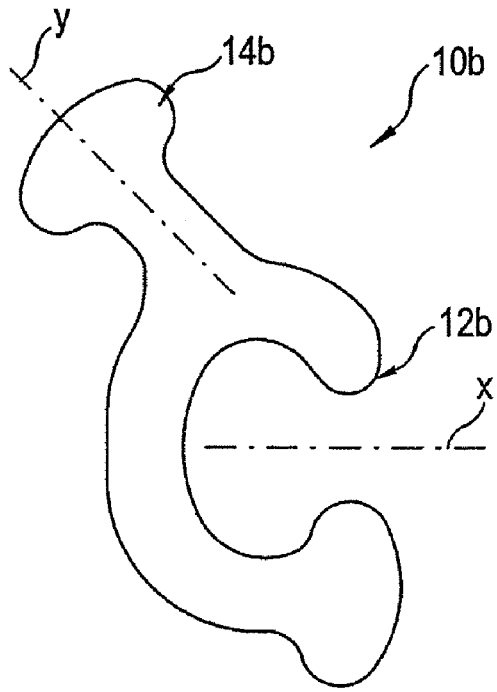
FIG. 5 is a top view of the front face of a third embodiment of a connection element based on the invention, where the attachment profile extends with its main direction of attachment at an angle of 135° to the main direction of attachment of the claw profile.

FIG. 5 shows a top view of the front face of a third embodiment of a connection element 10*b* based on the invention, where the attachment profile 14*b* extends with its main direction of attachment Y at an angle of 135° to the main direction of attachment X of the claw profile 12*b*.

Figure 6:
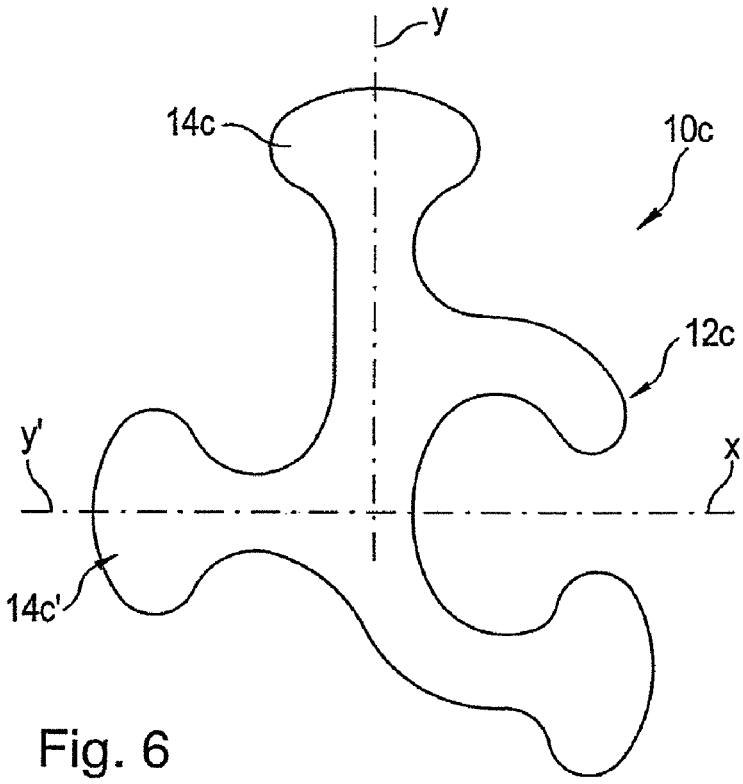
FIG. 6 is a top view of the front face of a fourth embodiment of a connection element based on the invention with a claw profile and two identical attachment profiles, whereby the first attachment profile extends with its main direction of attachment at an angle of 90° and the second attachment profile at an angle of 180° to the main direction of attachment of the claw profile.

FIG. 6 shows a top view of the front face of a fourth embodiment of a connection element 10*c* based on the invention. Essentially, the connection element 10*c* corresponds to the connection element 10 shown in FIG. 1. The only difference is an additional attachment profile 14*c*' that is designed identically to the attachment profile 14*c* but protrudes from the center strip 16*c* of the claw profile 12*c*, whereby the first attachment profile 14*c*, in the same manner as with the connection element 10, extends with its main direction of attachment Y at an angle of 90° and the second attachment profile 14*c*' with its main direction of attachment Y' at an angle of 180° to the main direction of attachment X of the claw profile 14*c*.

Figure 7:
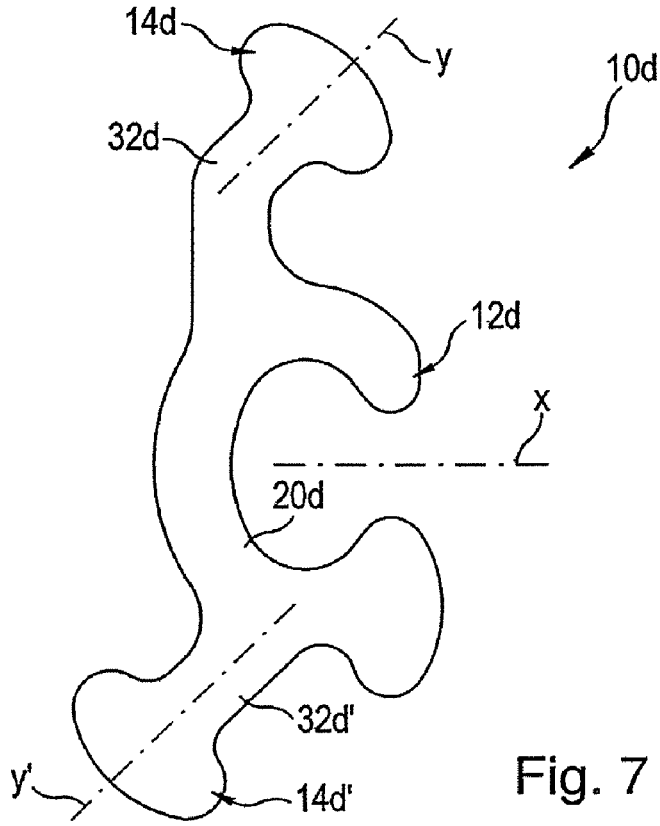
FIG. 7 is a top view of the front face of a fifth embodiment of a connection element based on the invention with a claw profile and two identical attachment profiles, whereby the first attachment profile is connected to the claw profile via a connection strip and extends with its main direction of attachment at an angle of 90° to the main direction of attachment of the claw profile, while the second attachment profile extends at an angle of 135° to the main direction of attachment of the claw profile.

FIG. 7 shows a top view of the front face of a fifth embodiment of a connection element 10*d* based on the invention with a claw profile 12*d* and two identical attachment profiles 14*d* and 14*d*'. The first attachment profile 14*d* exhibits an angled neck strip 32*d* in the same manner as the connection element 14*a* shown in FIG. 4 such that the main direction of attachment Y extends at an angle of 45° to the main direction of attachment X of the claw profile 12*d*. The second attachment profile 14*d*' protrudes with its neck strip 32*d*' from the hook strip 20*d* shown at the bottom of FIG. 7 such that the main direction of attachment Y' extends at an angle of 135° to the main direction of attachment X of the claw profile 12*d*.

Figure 8:
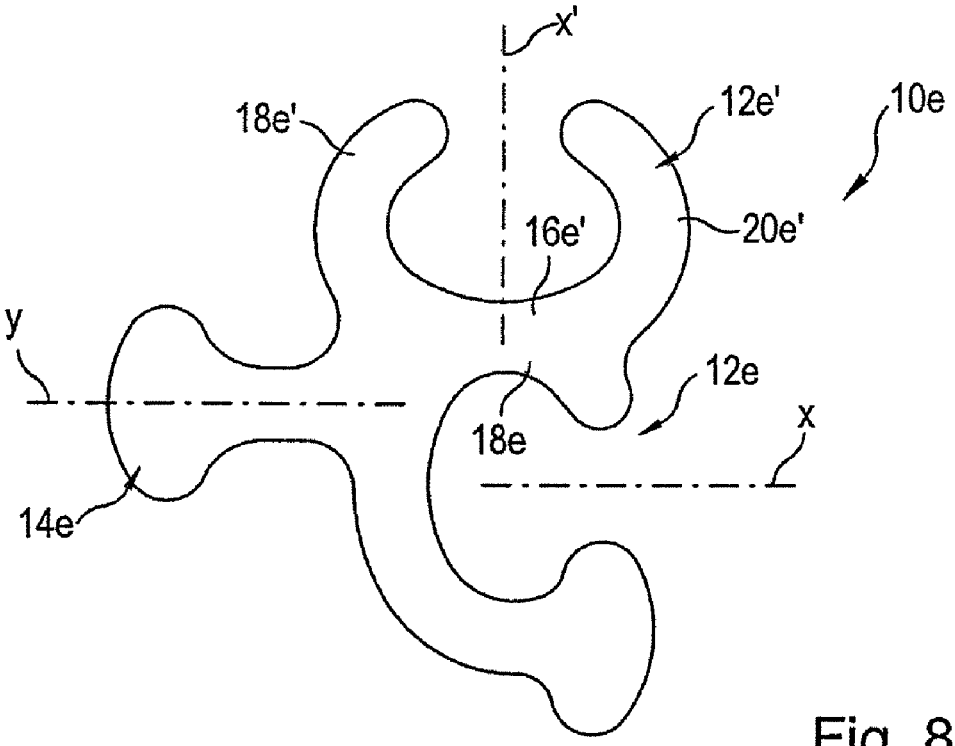
FIG. 8 is a top view of the front face of a sixth embodiment of a connection element based on the invention with two claw profiles and an attachment profile, whereby the second claw profile extends with its main direction of attachment at an angle of 90° and the attachment profile at an angle of 180° to the main direction of attachment of the first claw profile.

FIG. 8 shows a top view of the front face of a sixth embodiment of a connection element 10*e* based on the invention with two claw profiles 12*e* and 12*e*' and an attachment profile 14*e*. The first claw profile 12*e* corresponds in its design to the claw profile 12 of the connection element 10. The second claw profile 12*e*' is molded to the hook strip 18*e* of the first claw profile 12*e* with its center strip 16*e*' and extends with its main direction of attachment X' at an angle of 90° to the main direction of attachment X of the first claw profile 12*e*. Furthermore, at the second claw profile 12*e*', the head strip is missing, i.e., the two hook strips 18*e*' and 20*e*' are built identically.

The attachment profile 14*e*' is molded to the transition of the center strip 16*e* of the first claw profile 12*e* into the second claw profile 12*e*', whereby its main direction of attachment Y extends at an angle of 180° to the main direction of attachment X of the first claw profile 12*e*.

Figure 9:
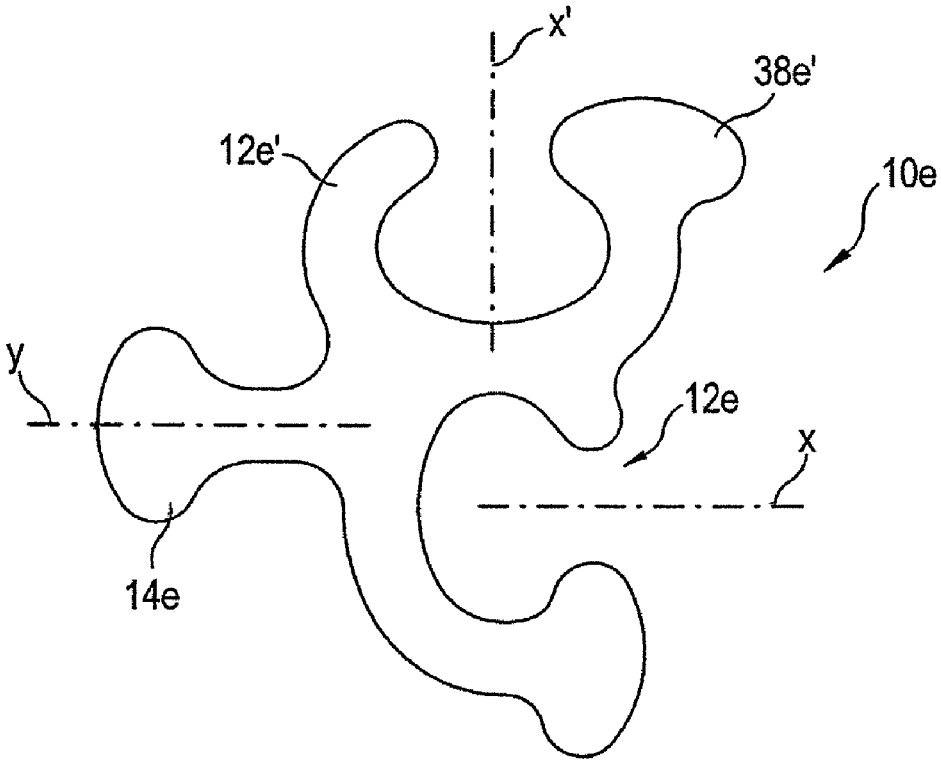
FIG. 9 is a top view of the front face of a development of the connection element shown in FIG. 8, where a head strip is provided at the second claw profile as well.

FIG. 9 shows a top view of the front face of a development of the connection element 10*e* shown in FIG. 8, where a head strip 38*e* is provided at the second claw profile 12*e*' as well.

Figure 10:
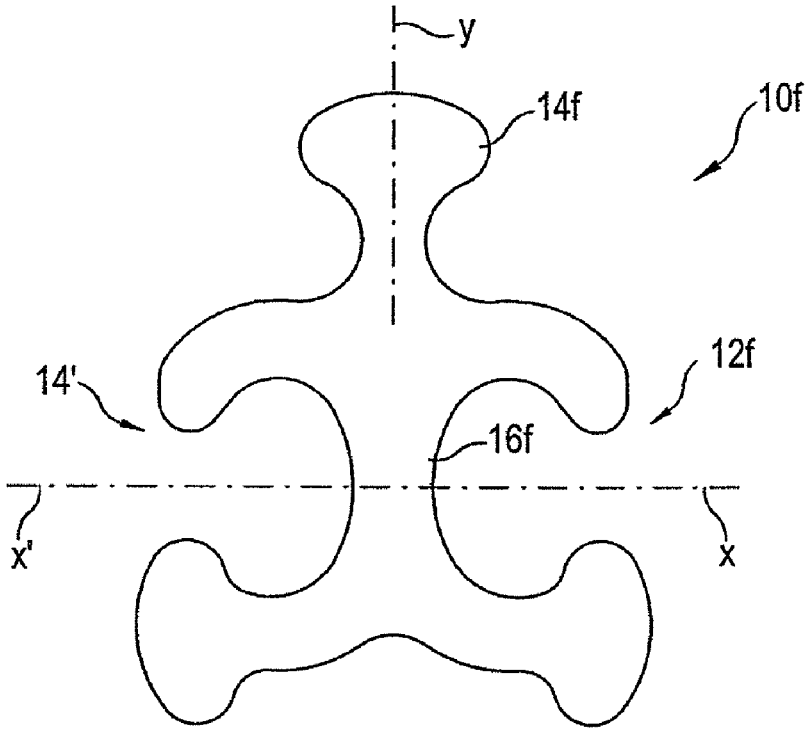
FIG. 10 is a top view of the front face of a seventh embodiment of a connection element based on the invention with two claw profiles and an attachment profile, whereby the two claw profiles are designed mirror-symmetrical to each other and the attachment profile extends at an angle of 90° to the main direction of attachment of the first claw profile.

FIG. 10 shows a top view of the front face of a seventh embodiment of a connection element 10*f* based on the invention that is built of two claw profiles 12*f* and 12*f*' and an attachment profile 14*f*. The two claw profiles 12*f* and 12*f*' are designed mirror-symmetrical to each other and have a common center strip 16*f*. In the center between the two claw profiles 12*f* and 12*f*', the attachment profile 14*f* protrudes and extends at an angle of 90° to the main direction of attachment X of the first claw profile 12*f*.

Figure 11:
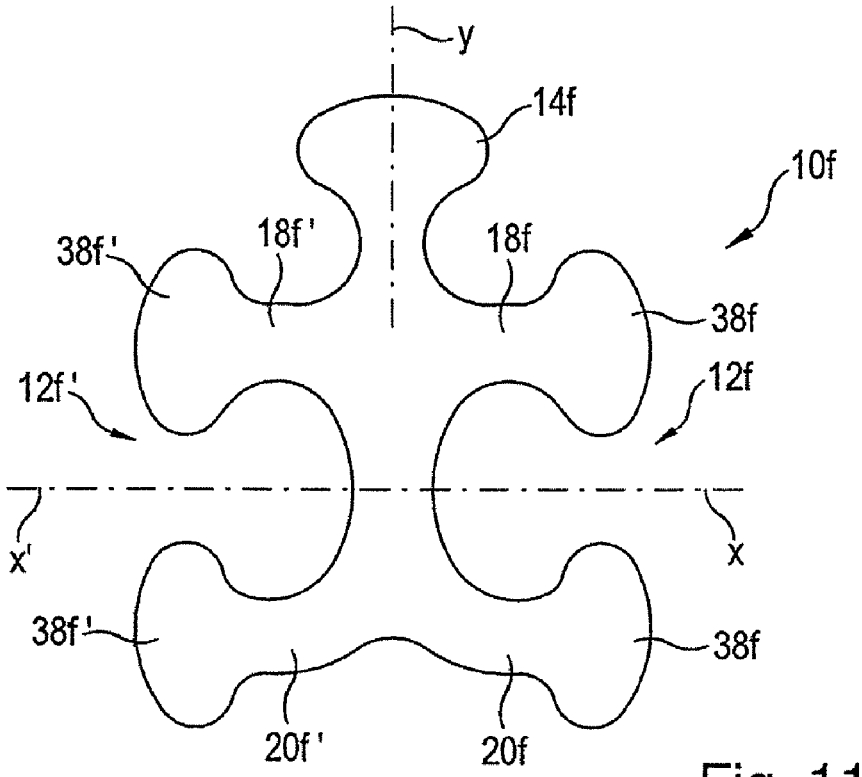
FIG. 11 is a top view of the front face of a development of the connection element shown in FIG. 10, where both hook strips of the two claw profiles are each provided with a head strip.

FIG. 11 shows a top view of the front face of a development of the connection element 10*f* shown in FIG. 10, where both hook strips 18*f* and 20*f* as well as 18*f*' and 20*f*' of the two claw profiles 12*f* and 12*f*' are each provided with a head strip 38*f* and 38*f*', respectively.

Figure 12:
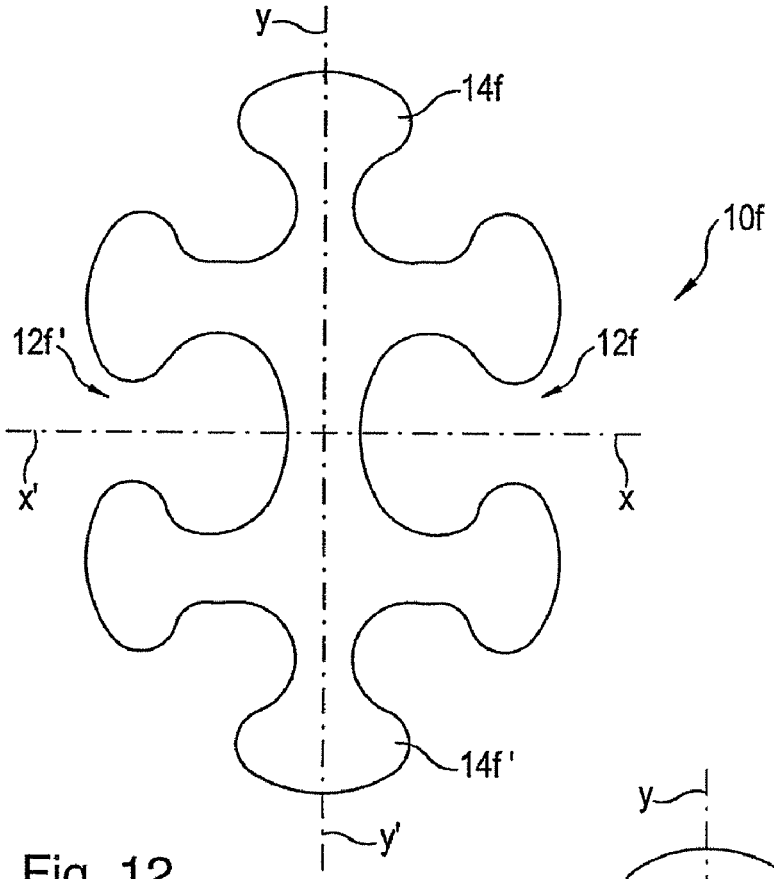
FIG. 12 is a top view of the front face of a development of the connection element shown in FIG. 11, where an additional attachment profile is provided mirror-symmetrical to the first attachment profile.

FIG. 12 shows a top view of the front face of a supplementary development of the connection element 10*f* shown in FIG. 11, where an additional attachment profile 12*f'* is provided mirror-symmetrical to the first attachment profile 12*f*.

Figure 13:
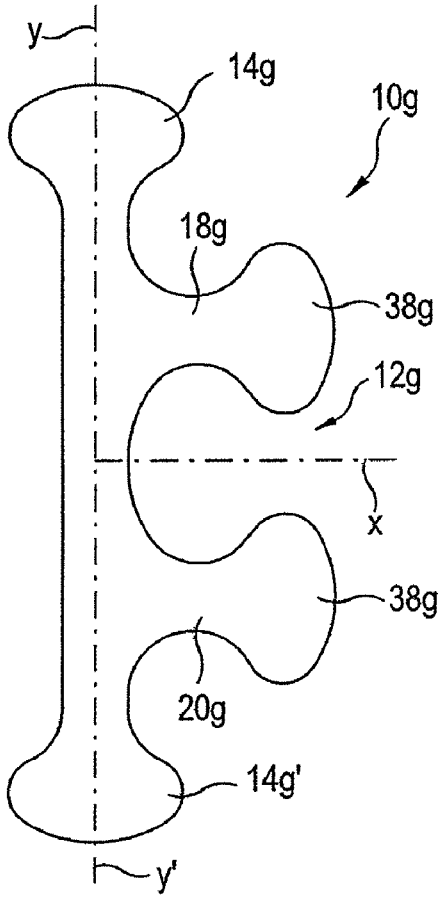
FIG. 13 is a top view of the front face of an eighth embodiment of a connection element based on the invention, where a claw profile and two attachment profiles are provided, whereby the claw profile is provided with a head strip at each of its hook strips and where the two attachment profiles run with their main direction of attachment at an angle of 90° or 270°, respectively, to the main direction of attachment of the claw profile.

Finally, FIG. 13 shows a top view of the front face of an eighth embodiment of a connection element 10*g* based on the invention. For this connection element 10*g*, a claw profile 12*g* and two attachment profiles 14*g* and 14*g'* are provided, whereby the claw profile 12*g* is provided with a head strip 38*g* at each of its hook strips 18*g* and 20*g*. The two attachment profiles 14*g* and 14*g'* run with their main directions of attachment Y and Y' at angles of 90° and 270°, respectively, to the main direction of attachment X of the claw profile 12*g*.

The presented embodiments show the diverse design options of the connection element 10 based on the invention. Depending on the purpose of the application, it is also possible for the attachment profile 14 to run with its main direction of attachment Y at a different angle to the main direction of the attachment X of the claw profile 12. Furthermore, the cross-sections of the lock chamber or of the head strips may be round or elliptical or exhibit other cross-sectional shapes that are rotation-symmetric with regard to the main direction of attachment X.

There has thus been shown and described a novel connection element and a sheet pile wall with connection element therefor which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A connection element of a constant cross-section for sheet pile wall components, such as sheet piles that have one of either a head strip without a claw strip or a claw strip without a head strip along their lateral edges to facilitate their interconnection, with said connection element having a claw profile, for engaging a head strip of a sheet pile wall component, which exhibits a neck strip and a head strip; wherein the claw profile exhibits a claw-shaped lock formed by two hook strips, as well as having an attachment profile, for engaging in the claw-shaped lock strip of a sheet pile wall component, which exhibits a straight neck strip and a head strip, with a larger cross-section than the neck strip, provided at its free end; and wherein one additional head strip is formed at the free end section of at least one of the two hook strips of the claw profile for engaging the claw strip of a sheet pile wall component, whereby either the head strip or the claw strip of a sheet pile wall component may be engaged with the claw profile of the connection element.

2. A connection element as defined in claim 1, wherein the hook strip that is provided with the additional head strip has a curved contour and wherein its free end section transitions into the additional head strip such that the free end section of the curved hook strip forms a portion of the outer contour of the additional head strip and at the same time a portion of the inner contour of the lock chamber.

3. A connection element as defined in claim 1, wherein the claw-shaped lock of the claw profile exhibits an oval cross-sectional shape, wherein the inner contours of the curved hook strips of the claw profile that define the lock chamber are mirror-symmetrical to each other, and wherein their end sections define the open jaw of the claw-shaped lock.

4. A connection element as defined in claim 1, wherein the main direction of attachment (X) of the claw profile, along which the sheet pile wall component in its neutral position, is to engage in the connection element, and wherein the main direction of attachment (Z) of the additional head strip that is provided at the claw profile extends parallel to the direction (X).

5. A connection element as defined in claim 1, wherein the head strip of the attachment profile and the additional head strip of the claw profile exhibit an at least approximately identical oval cross-sectional shape, and wherein the main axes of the head strips, which exhibit an oval cross-section, run perpendicular to their respective main direction of attachment (Y, Z), along which the sheet pile wall components are to engage in their respective neutral positions.

6. A connection element as defined in claim 1, wherein the main direction of attachment (Y) of the attachment profile extends at a specified angle relative to the main direction of attachment (X) of the claw profile.

7. The connection element as defined in claim 6, wherein the specified angle is selected from the group consisting of 45°, 90°, 135° and 180°.

8. A connection element as defined in claim 6, wherein the main direction of attachment (Y) of the attachment profile extends at an angle of 90° relative to the main direction of attachment (X) of the claw profile, and wherein a second identically designed attachment profile is provided, whose main direction of attachment (X') extends at an angle of 180° relative to the main direction of attachment (X) of the claw profile.

9. A connection element as defined in claim 6, wherein the main direction of attachment (Y) of the attachment profile extends at an angle of 45° relative to the main direction of attachment (X) of the claw profile, and wherein a second identically designed attachment profile is provided, whose main direction of attachment (Y') extends at an angle of 135° relative to the main direction of attachment (X) of the claw profile.

10. A connection element as defined in claim 6, wherein the main direction of attachment (Y) of the attachment profile extends at an angle of 90° relative to the main direction of attachment (X) of the claw profile, wherein a second identically designed attachment profile is provided, whose main direction of attachment (Y') extends at an angle of 270° relative to the main direction of attachment of the claw profile, and wherein both hook strips of the claw profile are each provided with a head strip.

11. A connection element as defined in claim 1, further comprising an additional claw profile that includes a claw-shaped lock formed by two identically designed hook strips with an inner contour corresponding to the inner contour of the lock chamber of the first claw profile.

12. A connection element as defined in claim 11, wherein the main direction of attachment (X') of the additional claw profile extends at an angle of 90°, and the main direction of attachment (Y) of the attachment profile extends at an angle of 180° relative to the main direction of attachment (X) of the first claw profile.

13. A connection element as defined in claim 11, wherein the additional claw profile exhibits a head strip at the end section of at least one of its hook strips, with said head strip being designed identically to the additional head strip of the first claw profile, wherein the head strip of the additional claw profile is preferably formed at the end of the hook strip that is at a greater distance to the attachment profile.

14. A connection element as defined in claim 11, wherein the two claw profiles are mirror-symmetric to each other, wherein the main direction of attachment (Y) of the attachment profile extends at an angle of 90° relative to the main direction of attachment (X, X') of the two claw profiles, and wherein each claw profile has a head strip at its hook strip that is disposed at a distance from the attachment profile.

15. A connection element as defined in claim 14, wherein both hook strips of each claw profile are provided with a head strip.

16. A connection element as defined in claim 15, wherein an additional attachment profile is provided that is designed mirror-symmetric to the first attachment profile.

17. A sheet pile wall comprised of several sheet piles, wherein at least two sheet piles are connected to each other through a connection element as defined in claim 1.

* * * * *